United States Patent [19]

Henry et al.

[11] 4,454,814

[45] Jun. 19, 1984

[54] SELECT-FIRE SYSTEMS AND METHODS FOR PERFORATING GUNS

[75] Inventors: Walter B. Henry, Fort Worth; John F. McNeely, Cleburne; Harrold D. Owen, Fort Worth, all of Tex.

[73] Assignee: Pengo Industries, Inc., Fort Worth, Tex.

[21] Appl. No.: 396,027

[22] Filed: Jul. 7, 1982

[51] Int. Cl.[3] ..... F42D 1/04; E21B 43/118

[52] U.S. Cl. ..... 102/200; 102/217; 175/4.55

[58] Field of Search ..... 102/217, 200; 175/4.55

[56] References Cited

U.S. PATENT DOCUMENTS

| | | | |
|---|---|---|---|
| 3,773,120 | 11/1973 | Stroud et al. | 175/4.55 |
| 4,099,467 | 7/1978 | MacKellar et al. | 102/217 |
| 4,208,966 | 6/1980 | Hart | 175/4.55 |
| 4,314,507 | 2/1982 | Seligmann | 102/217 |

*Primary Examiner*—Charles T. Jordan

*Attorney, Agent, or Firm*—Wm. T. Wofford; James C. Fails; Arthur F. Zobal

[57] ABSTRACT

The invention relates to improved systems and methods for selectively firing perforating guns in well bores and is concerned primarily with the production of a positive confirmation to the effect that each actuation at the operator control station intended to cause a firing of a particular shaped charge did or did not in fact result in the firing of that shaped charge. Such positive confirmation is accomplished by methods which involve the passage of measuring current from a constant current source through certain conductive loops to develop signals that are a function of the conductive loop resistance, the storage and comparison of said signals, and the display of resultant information. Due to certain phenomena, satisfactory measurement results will not be achieved unless a measuring current of substantial magnitude is used. The various parameters involved are treated.

2 Claims, 5 Drawing Figures

SELECT-FIRE SYSTEMS AND METHODS FOR PERFORATING GUNS

FIELD OF INVENTION

The invention relates to improved systems and methods for selectively firing perforating guns in well bores.

DESCRIPTION OF THE PRIOR ART

It is common practice to selectively fire perforating guns in well bores in the oil well completion process. Each gun is made up of a number of shaped charges, each of which is contained in a separate gun compartment. The shaped charges are usually fired sequentially, beginning at the bottom of the gun. The first shaped charge to be fired is connected to a ground, and the firing of that shaped charge will, unless there is a malfunction, result in the removal of that ground connection and grounding the next shaped charge in the sequence. The firing of each shaped charge, unless there is a malfunction, will result in the removal of the ground connection for that shaped charge and grounding the next shaped charge in the sequence. The shaped charges are fired by the passing of a direct current, usually about 500 milliamperes, through the shaped charge detonator device. The firing circuit is arranged, by the use of diodes, such that current of opposite polarity is required to fire adjacent charges.

It is very important that the operator should have a positive confirmation to the effect that each actuation at his control station intended to cause a firing of a particular shaped charge did or did not in fact result in the firing of that shaped charge. Various systems to achieve such positive confirmation are represented in prior art, as, for example, by U.S. Pat. No. 3,733,120, but none have proved to be entirely satisfactory.

The objective of the present invention is to provide improved select-fire systems and methods to accomplish the positive confirmation above mentioned.

SUMMARY OF THE INVENTION

Figure 1:
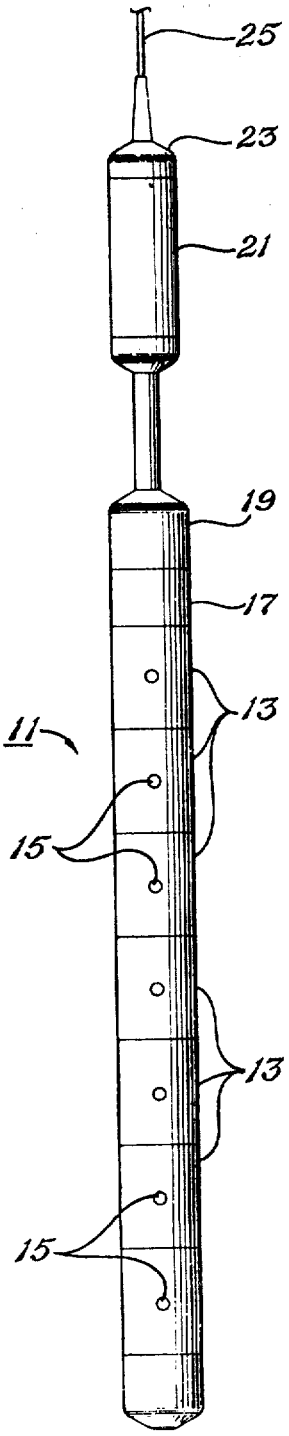
FIG. 1 is a schematic diagram showing typical downhole equipment in which the present invention may be incorporated.

The present invention relates to improved systems and methods for selectively firing perforating guns in well bores and is concerned primarily with the production of a positive confirmation to the effect that each actuation at the operator control station intended to cause a firing of a particular shaped charge did or did not in fact result in the firing of that shaped charge. Such positive confirmation is accomplished by methods which involve the passage of measuring current from a constant current source through certain conductive loops to develop signals that are a function of the conductive loop resistance, the storage and comparison of said signals, and the display of resultant information. The conductive loops include in each case the single conductor wireline, the downhole portion of the outer conductor or sheath of the wireline and the current path through the gun. There may be initially two current paths through the gun, one in each current polarity direction, or initially only a single current path through the gun. In either case the current path will include gun conductor means and certain resistances, and may also include a shaped charge detonator device. Also, in either case there will be a respective resistance associated with each gun shaped charge except the lowermost one and connected in series with the gun conductor means. Further, in either case, the gun will incorporate means designed to act responsive to the firing of a respective shaped charge to arm the next successive shaped charge by completing a circuit from the junction of one terminal of its respective detonator device and a respective resistance and through the respective detonator device to ground, and at the same time to open the circuit through the last mentioned resistance to ground.

Prior to the firing of the first shaped charge, a measuring current from a constant current source is passed through the conductive loop for each current path through the gun to develop a first signal in each case, which signal is a function of the resistance of the respective conductive loop. This first signal is utilized to produce on a display an identification of the first shaped charge to be fired and also is stored by means such as a microcomputer for later comparison purposes. After the firing of each shaped charge, measuring current is again passed through the respective conductive loop to generate a further signal that is a function of the resistance of the respective conductive loop and such signal is compared with the first signal by means such as a microcomputer to develop a comparison quantity. For each gun condition with regard to the number of shaped charges that have been fired there should be a unique conductive loop resistance comparison quantity. This quantity should be zero when no shaped charges have been fired and should increase as each consecutive shaped charge is fired by an increment equal to the resistance change that should take place, which typically is the deletion of one gun current path resistance. Since the resistance of the wireline single conductor and wireline sheath will be essentially constant for a fixed position of the gun in the well bore, the only resistance variation as shaped charges are fired should be that due to resistance changes in the current path through the gun.

We have found that a measuring and comparison system of the type hereinabove described will not yield satisfactory results unless a measuring current of substantial magnitude is used. Due to phenomena that is not fully understood there may be anomalies present in the conductive loops the resistance of which is to be measured, such as spontaneous potentials, self potential and stray currents, and these anomalies can result in unacceptable measurement errors. The anomalies present and their magnitude can vary considerably from well to well. Consequently the magnitude of the measuring current must be great enough to insure that the maximum currents that could occur in the conductive loops due to the anomalies present will be sufficiently small relative to the magnitude of the measuring current as to render harmless their effect of the measurement. At the same time the magnitude of the measuring current must be comfortably less than that required for actuating a detonator device to fire a shaped charge. Since a current in the range of about 300 to 500 milliamperes is normally required for actuating a detonator device, it is felt that the maximum measuring current should be about 200 milliamperes. The exact minimum magnitude of measuring current that will consistantly yield satisfactory results is not known. It is felt, however, that about 20 milliamperes should be the minimum. In actual practice a measuring current of 100 milliamperes has been used and found to be satisfactory.

DESCRIPTION OF PREFERRED EMBODIMENT

Referring now to the drawings, in FIG. 1 there is shown a perforating gun 11 of the type utilized with the present invention. The perforating gun 11 is made up of a plurality of separate gun compartments 13 each of which contains a shaped charge 15. The uppermost gun compartment is connected to a top sub 17. An adapter sub 19 is connected between a Casing Collar Locator 21 and the top sub 17. A cable head 23 is connected to the Casing Collar Locator 21 and is fixed to the sheath 25 of a wireline, from which the Casing Collar Locator and gun assembly is suspended in a well bore.

Figure 2:
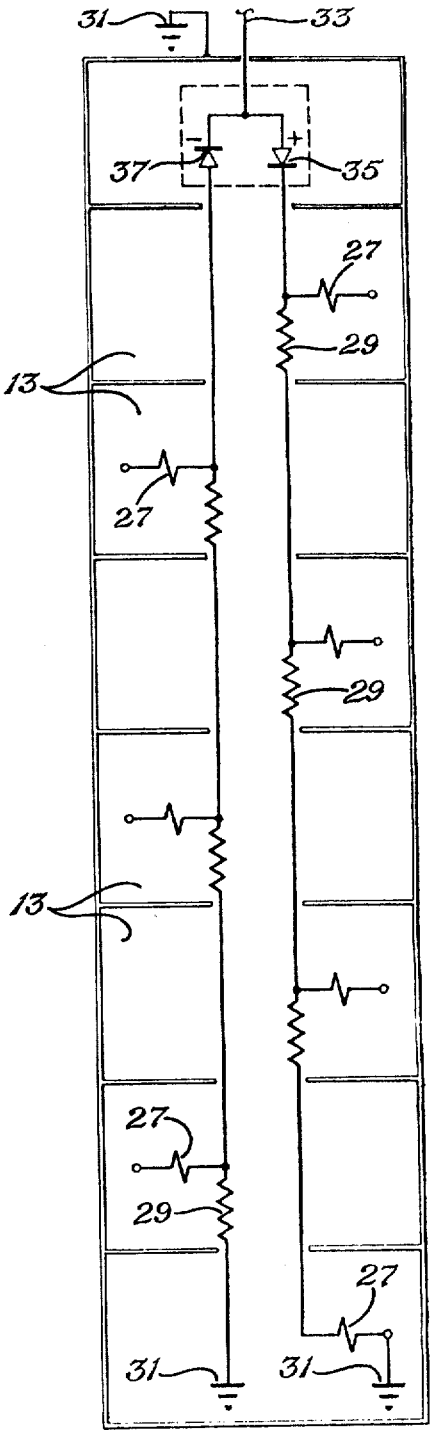
FIG. 2 is a schematic diagram showing a portion of the shaped charge firing circuits in accordance with a preferred embodiment with the present invention for a perforating gun having an odd number of shaped charges.
Figure 3:
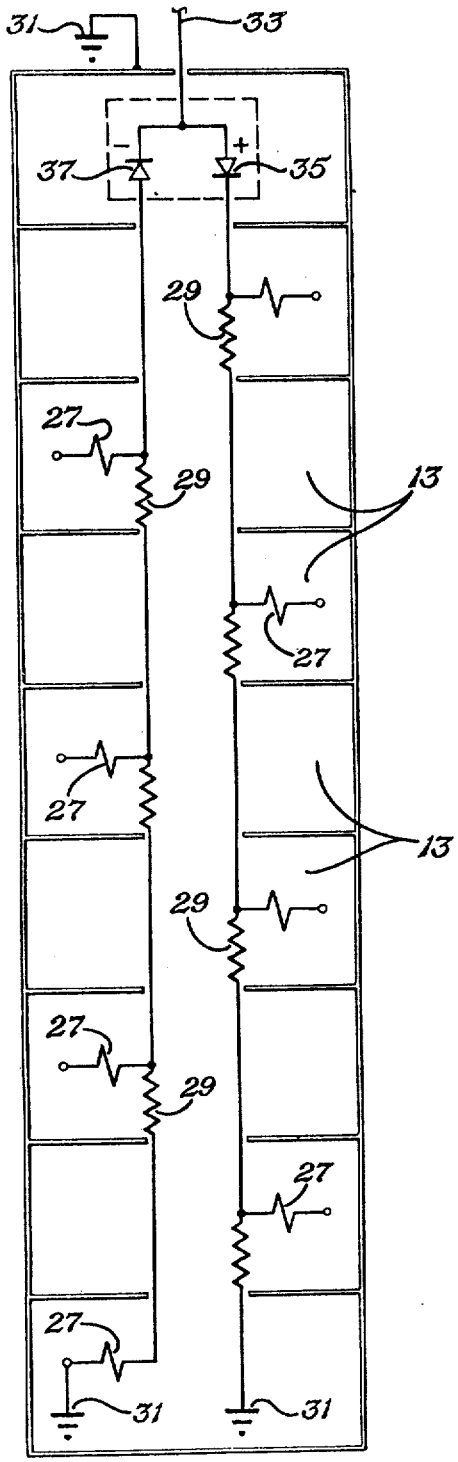
FIG. 3 is a schematic diagram showing a portion of the shaped charge firing circuits in accordance with a preferred embodiment of the present invention for a perforating gun having an even number of shaped charges.

In accordance with a preferred embodiment of the invention, the perforating gun 11 is of the two conductor type as shown by FIGS. 2 and 3. The perforating gun 11 of FIG. 2 carries an odd number of shaped charges (not shown) each of which has a detonator device 27 adapted for actuation when energized by an electric firing current of sufficient magnitude. Assuming that the shaped charges are designated by numbers beginning with 1 for the lowermost shaped charge and proceeding consecutively to the uppermost shaped charge, then it may be said that the detonator devices 27 associated with the odd numbered shaped charges are energized by a firing current flowing in the positive direction, while the detonator devices 27 associated with the even numbered shaped charges are energized by a firing current flowing in the negative direction. It may also be said that there is a respective resistance 29 associated with each shaped charge except the lowermost one and that each resistance 29 is connected between the detonator devices of the adjacent shaped charges in a respective firing circuit, except that the resistance associated with the lowermost even numbered shaped charge is connected between the associated detonator device and ground 31. Thus, a firing circuit portion may be traced from the wireline single conductor 33 in the positive current flow direction in series with a positively poled diode 35, each resistance 29 associated with an odd numbered shaped charge, and the detonator device 27 of the lowermost shaped charge to ground 31. Another firing circuit portion may be traced from the wireline single conductor 33 in the negative current flow direction in series with a negatively poled diode 37, each resistance 29 associated with an even numbered shaped charge, and to ground 31.

The perforating gun of FIG. 3 carries an even number of shaped charges (not shown) each of which has a detonator device 27 adapted for actuation when energized by an electric firing current of sufficient magnitude. Assuming that the shaped charges are designated by numbers beginning with 1 for the lowermost charge and proceeding consecutively to the uppermost charge, then it may be said that the detonator devices 27 associated with the odd numbered shaped charges are energized by a firing current flowing in the negative direction, while the detonator devices 27 associated with the even numbered shaped charges are energized by a firing current flowing in the positive direction. It may also be said that there is a respective resistance 29 associated with each shaped charge except the lowermost one and that each resistance 29 is connected between the detonator devices of the adjacent shaped charges in a respective firing circuit. except that the resistance associated with the lowermost even numbered shaped charge is connected between the associated detonator device and ground 31. Thus, a firing circuit portion may be traced from the wireline single conductor 33 in the negative current flow direction in series with a negatively poled diode 37, each resistance associated with an odd numbered shaped charge, and a detonator device 27 of the lowermost shaped charge to ground 31. Another firing circuit portion may be traced from the wireline single conductor 33 in the positive current flow direction in series with a positively poled diode 35, each resistance 29 associated with an even numbered shaped charge, and to ground 31.

Figure 4:
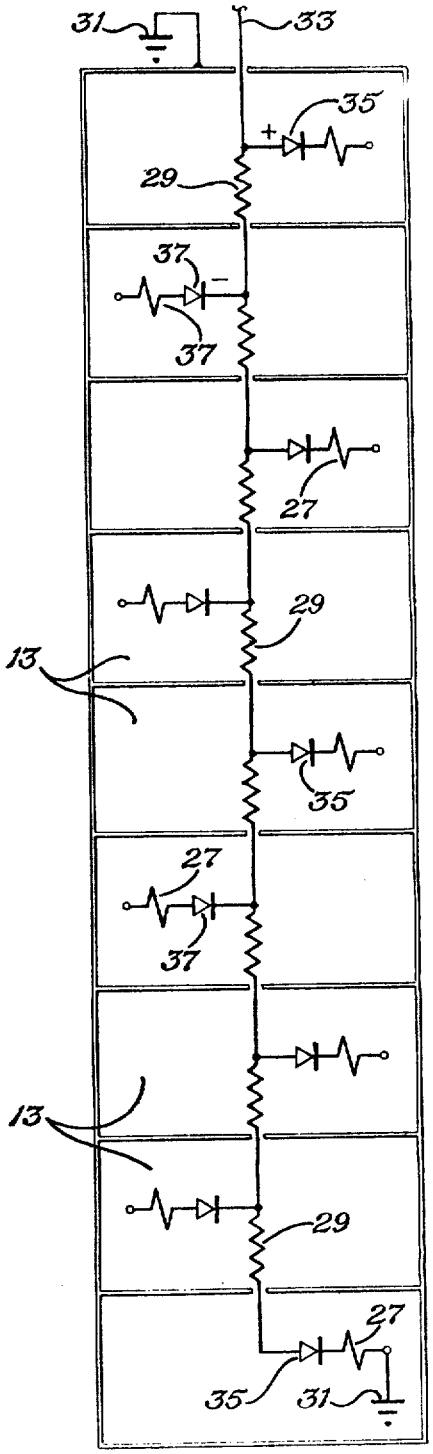
FIG. 4 is a schematic showing a portion of the shaped charge firing circuits in accordance with another embodiment of the present invention.

The perforating gun of FIG. 4 is of the single conductor type. In this gun, as in the two conductor type of FIGS. 2 and 3, the shaped charges are fired sequentially from bottom to top, with adjacent shaped charges being fired with oppositely poled current. Thus, also as in the two conductor type of FIGS. 2 and 3, assuming that the shaped charges are designated by numbers beginning with 1 for the lowermost shaped charge and proceeding consecutively to the uppermost shaped charge, then it may be said that the detonator devices associated with the odd numbered shaped charges are energized by a firing current flowing in the positive direction, while the detonator devices 27 associated with the even numbered shaped charges are energized by a firing current flowing in the negative direction. In the perforating gun of FIG. 4, there is a diode connected in series with each detonator device 27, with the diodes that are associated with the odd numbered shaped charges being positively poled diodes 35 and the diodes that there associated with the even numbered shaped charges being negatively poled diodes 37. It may also be said that there is a respective resistance 29 associated with each shaped charge except the lowermost one and that each resistance is connected between the diodes associated with adjacent shaped charges. Thus, a firing circuit portion may be traced from the wireline single conductor 33 in the positive flow direction in series with each resistance 29, positively poled diode 35, and the detonator device 27 of the lowermost shaped charge to ground 31. Assuming the convention, as is true of each of the perforating guns of FIGS. 2, 3 and 4 that the detonator device 27 for the uppermost shaped charge is always wired for positive firing current flow, then if a single conductor perforating gun similiar to that of FIG. 4 carried an even number of shaped charges, then the odd numbered shaped charges would receive negative firing current flow and the even numbered shaped charges would received positive firing current flow. The diodes would of course be poled accordingly.

The present invention is concerned primarily with the production of a positive confirmation of the effect that each actuation at the operator control station intended to cause a firing of a particular shaped charge did or did not in fact result in the firing of that shaped charge. This is accomplished by methods which involve the passage of measuring current through certain conductive loops to develop signals that are a function of the conductive loop resistance, the storage and comparison of said signals, and the display of resultant information. The schematic diagram of FIG. 5 shows typical down hole equipment and above ground equipment that can be utilized to practice the present invention.

Figure 5:
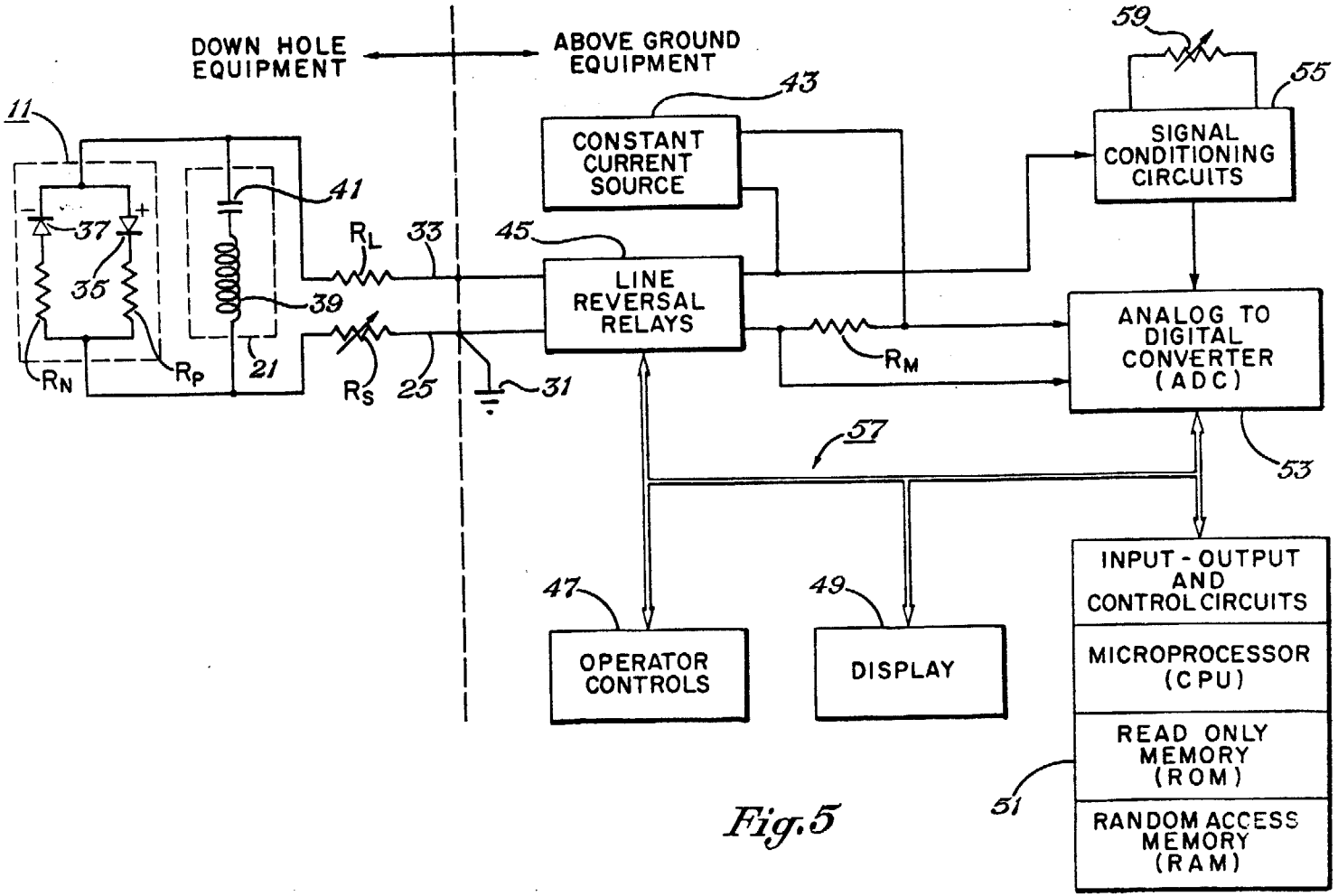
FIG. 5 is a schematic block diagram showing a select-fire system in accordance with a preferred embodiment of the present invention.

Referring now to FIG. 5, the resistance of the single conductor wireline 33 is represented by the resistance $R_L$, and the resistance of the down hole portion of the outer conductor or sheath 25 of the wireline is represented by the resistance $R_S$. The resistance $R_S$ is variable since it depends upon the length of wireline that is payed off the wireline reel, with the sheath 25 always being connected to ground 31 at the reel. The Casing Collar Locator 21 is shown within a dashed line rectangle as comprising the series combination of an inductance coil 39 and capacitor 41 connected between the single conductor wireline 33 and the sheath 25. The perforating gun 11 is represented by a dashed line rectangle and is shown as having a two conductor firing circuit with the current path through the gun in the positive direction being represented by the positively poled diode 35 and the resistance designated $R_p$, and the current path through the gun in the negative direction being represented by the negatively poled diode 37 and the resistance designated $R_N$. The resistance $R_p$ represents the resistance of the current path through the gun 11 in the positive direction and would include the sum of all resistances 29 that are in the current path and the resistance of any detonator device 27 that is in the current path. The resistance $R_N$ represents the resistance of the current path through the gun 11 in the negative direction and would include the sum of all of the resistances 29 that are in the current path and the resistance of any detonator device 27 that is in the current path.

The above ground equipment as shown by FIG. 5 includes a constant current source shown as a block 43, line reversal relays shown as a block 45, operator controls shown as a block 47, a display shown as a block 49, a microcomputer shown as a block 51, an analog to digital converter shown as a block 53, and signal conditioning circuits shown as a block 55.

The line reversal relays 45, operator controls 47, display 49, analog to digital converter 53 and microcomputer 51 are interconnected via conductor means 57 in a suitable manner as will be apparent to those skilled in the art. The output of the constant current source 43 is applied via the line reversal relays 45 in series with the conductive loops hereinabove mentioned and a current sensing resistor designated $R_M$. The voltages developed across the current sensing resistor $R_M$ are applied to the analog to digital converter 53. The signal conditioning circuits 55 filter and amplify the line voltage as appropriate for application to the analog to digital converter 53. An amplifier "line adjust" control shown as a variable resistance 59 allows "centering" the voltage to the analog to digital converter 53 when large variations in the length of the wireline that is paid out are encountered.

In operation, the perforating gun 11 is lowered into the well bore utilizing the conventional wireline reel mechanism to the desired depth as determined by conventional measuring and indicating apparatus including the Casing Collar Locator 21. A calibration and set up procedure will, under normal conditions, result in the presentation on the display 49 of the numeral 1, indicating that the system is ready for the firing of the lowermost shaped charge. At the same time, the display 49 includes an indication of whether the lowermost shaped charge is to be fired with current of positive or negative polarity. The calibration and set up procedure causes measurement under the direction and control of the microcomputer 51 of the resistance of the conductive loop for each current path through the gun 11. For the gun shown in FIGS. 2 and 3, there are two such current paths, while for the gun shown in FIG. 4 there is one current path. These resistance measurements are utilized in the determination of whether or not there is an initial problem with gun wiring, and are stored in the microcomputer for comparison purposes which will be hereinafter discussed.

The operator control means 47 is actuated to energize the firing circuit for the lowermost shaped charge, which would be represented on the display 49 by the numeral 1. As has been previously mentioned herein, the gun 11 incorporates conventional means designed to act responsive to the firing of a respective shaped charge to arm the next successive shaped charge by completing a circuit from the junction of one terminal of its respective detonator device and a respective associated resistance and through the respective detonator device to ground, and at the same time to open the circuit through the last mentioned resistance to ground. Taking the gun 11 of FIG. 3, for example, the initial conductive loop resistance measurement for the negative current path would include three resistances 29 and one detonator device 27, while the initial conductive loop resistance measurement for the positive current path would include four resistances 29. Responsive to the firing of the lowermost shaped charge, the detonator device 27 of the next consecutive shaped charge should be grounded and the circuit through its associated resistance 29 should be opened. Whether or not this is so is determined by the making of a second measurement of a resistance of the conductive loop for the positive current path and comparing this to the initial measurement for that conductive loop. Instead of there being four resistances 29 in the conductive loop, there should be three resistances 29 and one detonator device 27, and the comparison should reflect the appropriate resistance change. The measurement and comparison is accomplished by and under the direction and control of the microcomputer 51. If the resistance difference is what it should be, then the numeral 2 will appear on the display 49 indicating that all is in order for the firing of the next consecutive shaped charge. Otherwise, a malfunction is indicated. The process is repeated until the desired number of shaped charges have been fired.

It will be apparent to those skilled in the art that for each gun condition with regard to the number of shaped charges that have been fired there should be a unique conductive loop resistance comparison quantity. This quantity should be zero when no shaped charges have been fired and should increase as each consecutive shaped charge is fired by an increment equal to the resistance change that should take place, which typically is the deletion of one resistance 29. Since the resistance of the wireline single conductor 33 and wireline sheath 25 will be essentially constant for a fixed position of the gun 11 in the well bore, the only resistance variation as shaped charges are fired should be that due to resistance changes in the current path through the gun 11.

We have found that a measuring and comparison system of the type hereinabove described will not yield satisfactory results unless a measuring current of substantial magnitude is used. Due to phenomena that is not fully understood there may be anomalies present in the conductive loops the resistance of which is to be measured, such as spontaneous potentials, self potential and stray currents, and these anomalies can result in unacceptable measurement errors. The anomalies present and their magnitude can vary considerably from well to well. Consequently the magnitude of the measuring current must be great enough to insure that the maximum currents that could occur in the conductive loops due to the anomalies present will be sufficiently small relative to the magnitude of the measuring current as to render harmless their effect on the measurement. At the same time the magnitude of the measuring current must be comfortably less than that required for actuating a detonator device to fire a shaped charge. Since a current in the range of about 300 to 500 milliamperes is normally required for actuating a detonator device, it is felt that the maximum measuring current should be about 200 milliamperes. The exact minimum magnitude of measuring current that will consistantly yield satisfactory results is not known. It is felt, however, that about 20 milliamperes should be the minimum. In actual practice a measuring current of 100 milliamperes has been used and found to be satisfactory.

It should be noted that the value of the resistances 29 is typically about 10 ohms and the resistance of a detonator device 27 is typically about 1 ohm. It may also be noted that guns having two current paths as shown by FIGS. 2 and 3 are to be preferred over guns having a single current path as shown by FIG. 4. This is because the elimination of a resistance 29 from a conductive loop due to the firing of a shaped charge will result in a conductive loop percent resistance change for the case of the two current path gun that is approximately twice that for the case of the single current path gun.

We claim:

1. An improved method of selectively firing a perforating gun comprising the steps of:

a. providing a perforating gun having disposed therein a plurality of shaped charges arranged in a vertical array and to be fired sequentially beginning with the lowermost charge; with each shaped charge having a detonator device adapted for actuation when energized by an electric firing current of sufficient magnitude; with gun conductor means connected from the upper end of said perforating gun to ground; with a respective resistance associated with each said shaped charge except the lowermost one and connected in series with said gun conductor means; with said gun incorporating means designed to act responsive to the firing of a respective shaped charge to arm the next successive shaped charge by completing a circuit from the junction of one terminal of its respective detonator device and a respective said resistance and through the respective detonator device to ground, and at the same time to open the circuit through said last mentioned resistance to ground;

b. lowering said perforating gun on a single conductor wireline to the desired perforating depth in a well bore;

c. providing above ground equipment comprising a constant current source, signal storage means, signal comparison means, display means and operator control means;

d. passing a measuring current, having a magnitude of at least 20 milliamperes but insufficient to actuate a shaped charge detonator device, through each conductive loop which includes said single conductor wireline, the down hole portion of the outer conductor or sheath of said wireline and the current path through the gun in either of the positive and negative directions, to develop a first signal in each case which is a function of the resistance of said conductive loop;

e. utilizing said first signal to produce on said display an identification of the first shaped charge to be fired, and storing said first signal for use with said signal comparison means;

f. actuating said operator control means to energize the firing circuit for said first shaped charge to be fired;

g. passing said measuring current through a said conductive loop to develop a second signal which is a function of the resistance of said conductive loop;

h. utilizing said second signal in conjunction with said comparison means to produce on said display an identification of the second shaped charge to be fired;

i. actuating said operator control means to energize the firing circuit for said second shaped charge to be fired;

j. repeating said measuring, comparison, display and operator control actuation until the desired number of said shaped charges have been fired.

2. An improved method of selectively firing a perforating gun comprising the steps of:

a. providing a perforating gun having disposed therein a plurality of shaped charges arranged in a vertical array and to be fired sequentially beginning with the lowermost charge; with each shaped charge having a detonator device adapted for actuation when energized by an electric firing current of sufficient magnitude; with gun conductor means connected from the upper end of said perforating gun to ground and comprising a first current path of one polarity and a second current path of opposite polarity; with a respective resistance associated with each said shaped charge except the lowermost one and connected in series in a respective said current path; with said gun incorporating means designed to act responsive to the firing of a respective shaped charge to arm the next successive shaped charge by completing a circuit from the junction of one terminal of its respective detonator device and a respective said resistance and through the respective detonator device to ground, and at the same time to open the circuit through said last mentioned resistance to ground;

b. lowering said perforating gun on a single conductor wireline to the desired perforating depth in a well bore;

c. providing above ground equipment comprising a constant current source, signal storage means, signal comparison means, display means and operator control means;

d. passing a measuring current, having a magnitude of at least 20 milliamperes but insufficient to actuate a shaped charge detonator device, through each conductive loop which includes said single conductor wireline, the down hole portion of the outer conductor or sheath of said wireline and the current path through the gun in either of the positive and negative directions, to develop a first signal in each case which is a function of the resistance of said conductive loop;

e. utilizing said first signal to produce on said display an identification of the first shaped charge to be fired, and storing said first signal for use with said signal comparison means;

f. actuating said operator control means to energize the firing circuit for said first shaped charge to be fired;

g. passing said measuring current through a said conductive loop to develop a second signal which is a function of the resistance of said conductive loop;

h. utilizing said second signal in conjunction with said comparison means to produce on said display an identification of the second shaped charge to be fired;

i. actuating said operator control means to energize the firing circuit for said second shaped charge to be fired;

j. repeating said measuring, comparison, display and operator control actuation until the desired number of said shaped charges have been fired.

* * * * *